US006516545B2

(12) United States Patent
Jenkins, Jr.

(10) Patent No.: US 6,516,545 B2
(45) Date of Patent: Feb. 11, 2003

(54) COMBINATION TRENCHER AND VEHICLE

(76) Inventor: Homer Dolph Jenkins, Jr., Rte. 2, Box 186J, Preston, GA (US) 31824

( * ) Notice: Subject to any disclaimer, the term of this patent is extended or adjusted under 35 U.S.C. 154(b) by 0 days.

(21) Appl. No.: 09/781,091

(22) Filed: Feb. 12, 2001

(65) Prior Publication Data

US 2002/0112380 A1 Aug. 22, 2002

(51) Int. Cl.[7] ..... E02F 3/65
(52) U.S. Cl. ..... 37/362
(58) Field of Search ..... 37/352, 362, 902, 37/464, 468, 403; 172/315, 316, 492, 35

(56) References Cited

U.S. PATENT DOCUMENTS

| | | | | | |
|---|---|---|---|---|---|
| 2,817,167 | A | | 12/1957 | Barber | 37/86 |
| 3,130,506 | A | | 4/1964 | Laster | 37/86 |
| 3,398,471 | A | | 8/1968 | Brown | 37/86 |
| 3,754,341 | A | | 8/1973 | Caldwell et al. | 37/86 |
| 3,834,049 | A | | 9/1974 | Bond | 37/86 |
| 4,102,403 | A | * | 7/1978 | Steinberg | 172/40 |
| 4,459,767 | A | * | 7/1984 | Cartner | 37/81 |
| 4,483,084 | A | * | 11/1984 | Caldwell et al. | 37/86 |
| 4,681,145 | A | * | 7/1987 | York | 144/2 N |
| 4,833,797 | A | | 5/1989 | Slunecka et al. | 37/86 |
| 5,245,769 | A | | 9/1993 | Wammock | 37/357 |
| 5,765,650 | A | * | 6/1998 | Checkel | 172/681 |
| 6,068,064 | A | * | 5/2000 | Bettin et al. | 172/413 |
| 6,318,477 | B1 | * | 11/2001 | Bettin | 172/452 |
| 6,349,488 | B1 | * | 2/2002 | Mason | 37/94 |

* cited by examiner

*Primary Examiner*—Thomas B. Will
*Assistant Examiner*—Kristine Markovich
(74) *Attorney, Agent, or Firm*—Baker, Donelson, Bearman & Caldwell

(57) ABSTRACT

A combination trencher (10) and vehicle (11) is disclosed wherein the tractor (11) has a pair of mounting rods (23) and a mechanically driven transfer case (20) with a rotating hub (25) extending from the front of the vehicle. The trencher (10) has a frame (31) which includes two generally parallel mounting members (32) sized and shaped to receive the mounting rods (23) of the tractor (11), and a hydraulic digging attachment (39). The digging attachment (39) has a pivotal cutting boom (41), an endless loop digging chain (42), a hydraulic boom actuator (44), and a hydraulic chain drive (45). The hydraulic chain drive (45) includes a hydraulic motor (51) mounted to the cutting boom (41) which drives the digging chain (42). The hydraulic motor (51) is in fluid communication with the hydraulic pump (52) through a hydraulic control system (53).

6 Claims, 2 Drawing Sheets

COMBINATION TRENCHER AND VEHICLE

TECHNICAL FIELD

This invention relates to trenchers, and specifically to trenchers which are utilized in conjunction with a motorized vehicle.

BACKGROUND OF THE INVENTION

Trenchers have existed for many years. Trenchers have been designed as independent units which are coupled to a tractor or other vehicle for relocation purposes only, as shown in U.S. Pat. No. 2,817,167. These units have internal combustion engines coupled to an endless loop chain having a series of buckets or digging teeth. The endless loop chain is guided upon a boom or cutting bar. Because of the weight and size of these units, they tend to be very difficult to maneuver and operate.

Trenchers have also been designed to operate in conjunction with a motorized vehicle. These trenchers typically have hydraulic motors which actuate the endless loop chain, as shown in U.S. Pat. Nos. 3,754,341 and 3,398,471. Typically, the hydraulic motor of these trenchers is coupled to a hydraulic pump coupled to the internal combustion engine of the vehicle. As such, hydraulic lines extend between the vehicle and the trencher. These hydraulic lines, as well as other mechanical linkage between the vehicle and the trencher, must be disconnected when removing the trencher from the vehicle so that the vehicle may be used for other purposes. Because of the high pressure of the hydraulic fluid within these hydraulic lines the disconnection of the trencher from the vehicle has proven to be difficult and dangerous.

Trenchers have also been designed with mechanical linkages between the internal combustion engine of the vehicle and the trenching chain, as shown in U.S. Pat. Nos. 3,130,506 and 4,833,797. This linkage typically consists of a drive train and a plurality of coupling bars. Again, it is oftentimes a difficult task to disconnect the trencher from the vehicle due to the existence of these mechanical linkages. Furthermore, once the trencher is removed, the remaining linkage coupled to the vehicle must oftentimes be removed in order for the vehicle to operate properly and safely.

Accordingly, it is seen that a need remains for a trencher which may be quickly and easily connected to and later disconnected from a vehicle. It is to the provision of such therefore that the present invention is primarily directed.

SUMMARY OF THE INVENTION

In a preferred form of the invention a combination trencher and vehicle comprises, in combination, a mobile vehicle having a plurality of wheels and an internal combustion engine operatively coupled to at least one of the wheels, a first coupler portion mounted to one end of the vehicle which is operatively coupled to the internal combustion engine and which has a rotating first coupling member, a carriage releasably coupled to the vehicle, a second coupler portion coupled to the carriage which has a rotating second coupling member configured to mate releasably with the first coupling member of the first coupler portion, a hydraulic pump operatively coupled to the second coupling member, a hydraulic motor hydraulically coupled to the hydraulic pump, digging means including an endless loop digging chain coupled to the carriage and drivably coupled to the hydraulic motor, and control means hydraulically coupled to the hydraulic pump and the hydraulic motor for controlling the operation of the hydraulic motor. With this construction, the carriage may be disconnected from the vehicle and the second coupling means disconnected from the first coupling means to remove the digging means quickly and easily from the vehicle.

DETAILED DESCRIPTION

Figure 1:
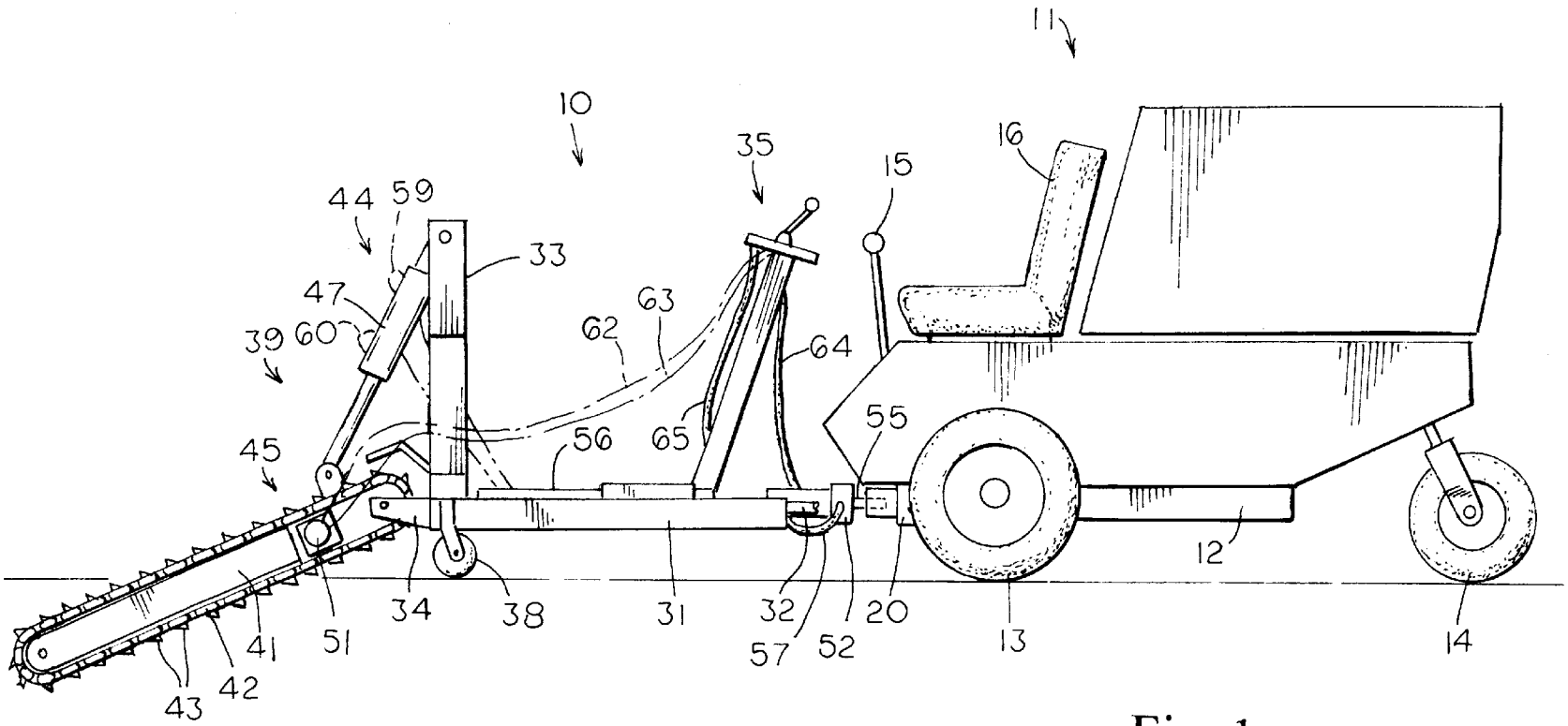
FIG. 1 is a side view of a trencher and vehicle embodying principles of the invention is a preferred form.

With reference next to the drawings, there is shown a trenching deck or trencher 10 coupled to a vehicle in the form of a conventional lawn tractor 11. The tractor 11 has a chassis 12, two front wheels 13, a maneuverable rear wheel 14 coupled to the steering stick 15, a seat 16, and an internal combustion engine 17 coupled to at least one of the wheels 13 or 14. The vehicle also includes a transfer case 20 operationally coupled to the internal combustion engine 17 via linkage, shown herein as a belt drive 22. The chassis 12 includes two generally parallel, forwardly extending mounting rods 23, best shown in FIG. 2.

The transfer case 20 is mounted to the front end of the chassis 12. The transfer case 20 has a pulley 24 coupled to the belt drive 22 which is also coupled to engine 17. The pulley 24 is operatively coupled to a rotating female receptacle member or hub 25 facing outwardly from the front of the tractor 11.

The trencher 10 has a carriage, frame or chassis 31 which includes two generally parallel mounting members 32 sized and shaped to receive the mounting rods 23 of the tractor 11, a vertical hydraulic support beam 33, a pair of mounting brackets 34 extending from the front of the frame 31, and a control panel 35. The two mounting members 32 include set bolts 37 adapted to be biased against the mounting rods 23 within the mounting members 32 so as to fix their position therein. The trencher 10 also includes two swiveling wheels 38 and a hydraulic digging attachment 39 mounted to the frame 31.

The hydraulic digging attachment 39 has a cutting boom 41 pivotally mounted to the mounting brackets 34, an endless loop digging chain 42 slidably mounted upon the boom 41 having a series of digging teeth or buckets 43, a hydraulic boom actuator 44, and a hydraulic chain drive 45. The hydraulic boom actuator 44 includes a hydraulic cylinder 47 having one end pivotally coupled to the support beam 33 and an opposite end pivotally coupled to the cutting boom 41 for pivotal movement of the boom.

Figures 2, 3:
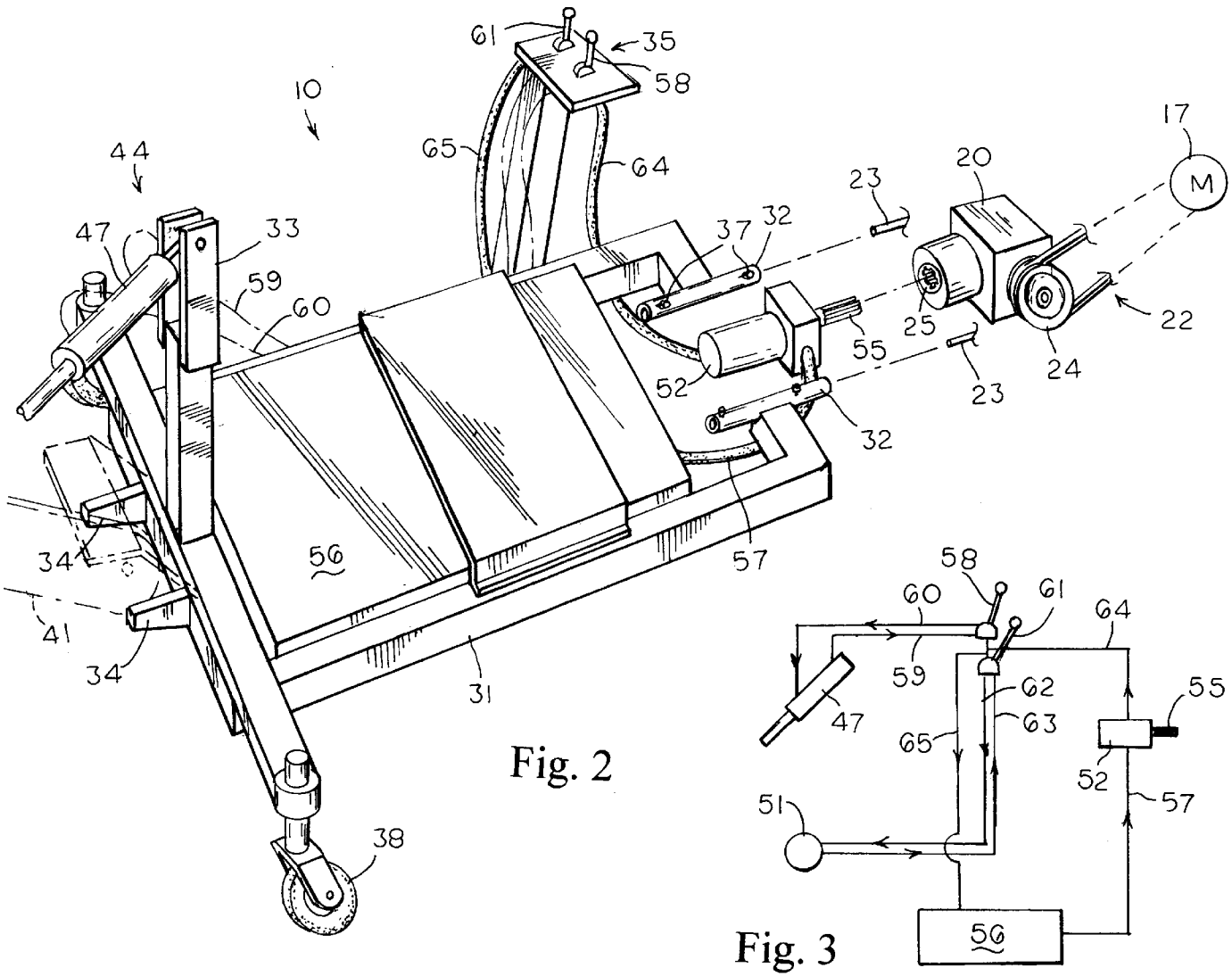
FIG. 2 is a perspective view of portions of the trencher and vehicle of FIG. 1.
FIG. 3 is a schematic view of the hydraulic system of the trencher of FIG. 1.

The hydraulic chain drive 45 includes a hydraulic motor 51 mounted to the cutting boom 41 which drives the digging chain 42. The hydraulic motor 51 is in fluid communication with a hydraulic pump 52 via a hydraulic control system. The hydraulic pump 52 has a spline 55 configured to be releasably received within the rotating hub 25, the spline 55 as used herein should be understood to comprise a coupler between the hydraulic pump 52 and transfer case 20. The hydraulic pump 52 is in fluid communication with a hydraulic fluid reservoir 56 through a hydraulic line 57. The hydraulic control system includes a boom pivoting control lever 58 actuatably coupled to hydraulic cylinder 47 though hydraulic lines 59 and 60, and a chain drive speed lever 61 actuatably coupled to chain drive hydraulic motor 51 through hydraulic lines 62 and 63, a hydraulic line 64 extending between the hydraulic pump 52 and control levers 58 and 61, and a return hydraulic line 65 extending between the control levers 58 and 61 and the fluid reservoir 56, as best shown in FIG. 3. It should be understood that the control levers are coupled to conventional hydraulic valves which control the flow of fluid through the associated hydraulic lines to the hydraulic cylinder 47 and hydraulic motor 51.

In use, the trencher 10 is connected to the tractor 11 by sliding the mounting rods 23 of the tractor into the mounting members 32 of the trencher and by sliding the hydraulic pump spline 55 into the hub 25 of the transfer case 20. The set bolts 37 are then tightened to secure the relative position of the mounting rods 23 therein.

Now, with the internal combustion engine 17 of the tractor 11 operating, the operator may engage the belt drive 22 so as to engage and actuate the transfer case 20. The operation of the transfer case 20 causes the hub 25 to rotate, which in turn causes the hydraulic motor 51 to operate through the rotation of the connecting spline 55. The operation of the hydraulic motor 51 pressurizes the hydraulic fluid within the hydraulic line 64 flowing to the controllers 58 and 61.

Actuation of the chain drive speed lever 61 causes pressurized hydraulic fluid to pass to and thereby actuate the hydraulic motor 51, in turn causing the digging chain 42 to be driven along the boom 41. Similarly, actuation of the boom pivoting control lever 58 causes pressurized hydraulic fluid to pass to the boom hydraulic cylinder 47 so as to extend or retract the cylinder and thereby pivotally force the boom 41 downward or upward relative to the ground, i.e. it provides a range of motion to the boom 41. The movement of the digging chain 42 and the downward force upon the boom 41 causes the digging chain 42 to remove earth from its path, i.e. causes the digging chain to create a trench. The tractor 11 may then be moved as the digging chain 42 is actuated to extend the length of the trench.

Once the trencher 10 is no longer needed it may be disconnected from the tractor 11 by simply untightening the set bolts 37, and removing the mounting rods 23 from the mounting member 32 while also removing the hydraulic pump spline 55 from the transfer case hub 25. As such, an operator is not required to disconnect high pressure hydraulic lines or disconnect complicated mechanical linkages in order to achieve this goal, a problem that has long existed with trenchers of the prior art.

It should be understood that other conventionally known linkage between the engine and the transfer case may be employed as an alternative to the belt drive shown in the preferred embodiment, such as by universal joints, hydraulics, and other equivalent means. Similarly, other types of mechanical members may be utilized as an alternative to the shown mounting rod and mounting member arrangement. Lastly, it should be understood that other means, such as rails, may be used as an alternative to the wheels of the preferred embodiment.

It thus is seen that a combination trencher and vehicle is now provided which enables one to quickly and easily disconnect the trencher from the vehicle. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A trenching apparatus comprising, in combination, a. a mobile vehicle having a plurality of wheels and an internal combustion engine operatively coupled to at least one said wheel;

b. a first coupler portion mounted to one end of said vehicle, said first coupler portion being operatively coupled to said internal combustion engine and having a rotating first coupling member;

c. a carriage releasably coupled to said vehicle;

d. a second coupler portion coupled to said carriage, said second coupler portion having a rotating second coupling member configured to mate releasably with said first coupling member of said first coupler portion;

e. a hydraulic pump operatively coupled to said second coupling member;

f. a hydraulic motor hydraulically coupled to said hydraulic pump;

g. digging means including an endless loop digging chain coupled to said carriage and drivably coupled to said hydraulic motor; and h. control means hydraulically coupled to said hydraulic pump and said hydraulic motor for controlling the operation of said hydraulic motor, whereby the carriage may be disconnected from the vehicle and the second coupling means disconnected from the first coupling means to remove the digging means quickly and easily from the vehicle.

2. The trenching apparatus of claim 1 wherein said carriage includes means for moving said digging means within a range of positions relative to the ground beneath said trenching apparatus.

3. The trenching apparatus of claim 1 further comprising an oil reserve tank mounted upon said carriage in fluid communication with said hydraulic pump.

4. A trenching apparatus comprising:

a mobile vehicle having a chassis, a plurality of wheels mounted to said chassis, an internal combustion engine mounted to said chassis and operationally coupled to at least one said wheel, a first coupler portion mounted to one end of said chassis and having a rotating first coupling member, and linkage means coupling said first coupling member to said internal combustion engine; and a removable trenching deck having a frame removably coupled to said mobile vehicle chassis, a plurality of frame supports mounted to said frame, a hydraulic system having a hydraulic pump, a second coupler portion operatively coupled to said hydraulic pump and having a rotating second coupling member configured to releasable mount to said first coupling member, a hydraulic motor hydraulically coupled to said hydraulic pump, hydraulic control means for controlling the operation of said hydraulic motor, and digging means operatively coupled to said hydraulic motor;

whereby the trenching deck frame may be disconnected from the vehicle chassis and the second coupling member disconnected from the first coupling member to remove the trenching deck quickly and easily from the vehicle.

5. The trenching apparatus of claim 4 wherein said trenching deck includes means for moving said digging means with in a range of positions relative to the ground beneath said trenching apparatus.

6. The trenching apparatus of claim 4 further comprising an oil reserve tank mounted upon said frame in fluid communication with said hydraulic pump.

* * * * *